US006409399B1

(12) United States Patent
Blakely et al.

(10) Patent No.: US 6,409,399 B1
(45) Date of Patent: Jun. 25, 2002

(54) PHOTOGRAPHIC PROCESSOR HAVING A ROLLER CAM REPLENISHMENT SYSTEM

(75) Inventors: Kevin H. Blakely, Rochester; Ralph L. Piccinino, Jr., Rush; Daniel M. Pagano, Honeoye Falls, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/745,720

(22) Filed: Dec. 21, 2000

(51) Int. Cl.[7] ..... G03D 13/00; G03D 3/02

(52) U.S. Cl. ..... 396/567; 396/578; 396/626; 396/617

(58) Field of Search ..... 396/567–570, 396/604, 617, 626, 636, 578, 620, 641; 355/27–29

(56) References Cited

U.S. PATENT DOCUMENTS

| | | | | | |
|---|---|---|---|---|---|
| 3,591,278 | A | * | 7/1971 | Limberger | 396/564 |
| 3,990,088 | A | | 11/1976 | Takita | 310/254 |
| 4,769,662 | A | | 9/1988 | Suzuki et al. | 396/632 |
| 4,888,607 | A | * | 12/1989 | Stutz et al. | 396/626 |
| 4,987,438 | A | * | 1/1991 | Goto et al. | 396/626 |
| 5,025,279 | A | | 6/1991 | Ellsworth | 396/568 |
| 5,307,109 | A | * | 4/1994 | Miyasaka et al. | 396/626 |
| 5,353,087 | A | | 10/1994 | Rosenburgh et al. | 396/636 |
| 5,903,795 | A | | 5/1999 | Piccinino, Jr. et al. | 396/626 |
| 6,213,657 | B1 | * | 4/2001 | Kobayashi | 396/604 |

* cited by examiner

*Primary Examiner*—D. Rutledge
(74) *Attorney, Agent, or Firm*—David A. Novais

(57) ABSTRACT

The present invention provides for a processor or processing arrangement which includes a replenishment system that meters or dispenses an amount of replenishment solution in direct relation to an amount of photosensitive media that passes through the processor or processing arrangement. The replenishment system includes a dispensing chamber and a cam roller that is operationally associated with a conveying roller. The cam roller engages a valve on the dispensing chamber. When the valve is moved to an open position in relation to a rotation of the cam roller, an amount of processing solution is metered out of the chamber in an amount related to the amount of rotation of the conveying roller.

14 Claims, 4 Drawing Sheets

PHOTOGRAPHIC PROCESSOR HAVING A ROLLER CAM REPLENISHMENT SYSTEM

FIELD OF THE INVENTION

The present invention relates to the field of photography, and particularly, to a photosensitive material processing apparatus having a roller cam replenishment system.

BACKGROUND OF THE INVENTION

The processing of photosensitive material involves a series of steps such as developing, bleaching, fixing, washing and drying. These steps lend themselves to mechanization by conveying a continuous web of film or cut sheets of film or photographic paper sequentially through a series of stations or tanks, each one containing a different processing liquid appropriate to the process step at that station.

There are various sizes of photographic film processing apparatuses, i.e., large photofinishing apparatuses and microlabs. A large photofinishing apparatus utilizes tanks that contain approximately 100 liters of each processing solution. A small photofinishing apparatus or microlab utilizes tanks that may contain less than 10 liters of processing solution.

As noted above, during the processing of photosensitive material, the photosensitive material is conveyed through a processor which may contain a series of stations or tanks. As the photosensitive material is processed, the strength of the processing solution is diminished and will eventually become exhausted. To prevent the continual weakening of the processing solution, additional fresh processing solution is added to the processor to replenish the solution. A drawback with conventional replenishment systems is that generally, replenishment is not directly proportional to the amount of processing solution extracted by the photosensitive media.

Further, some replenishment systems, such as the replenishment system described in U.S. Pat. No. 5,353,087 use complicated bellows, pumps and motor drive mechanisms, as well as electronic systems for driving the pump and bellows systems. This adds cost and complexity to the processor. Also, the use of pump and bellows systems increases maintenance requirements for the processor.

SUMMARY OF THE INVENTION

The present invention provides for a photographic processor which includes a system that meters an amount of replenishment solution in direct relationship to the amount of photosensitive media passing through the processor. The system of the present invention utilizes a cam in combination with a conveying roller. The cam engages a valve on a dispensing chamber. When the valve is opened, an amount of processing solution is metered out in response to the amount that the conveying roller is rotated. Thus, a longer piece of media will get more replenishment and vise versa.

The system of the present invention not only drives media but replenishes at the same time. Also, the system of the present invention will replenish only what the media extracts and eliminates the use of bellows pumps, drive motors and associated electronics. Further, the system of the present invention will replenish when the drive is active.

Therefore, the present invention relates to a processor for processing photosensitive media. The processor comprises a processing channel through which a photosensitive media is passed. The processing channel contains processing solution for application to the photosensitive media passing therethrough. The processor further includes a replenishment system that is adapted to replenish the processing solution in the processing channel. The replenishment system comprises a chamber that holds a processing solution and a dispensing mechanism that dispenses the processing solution from the chamber in direct relationship with an amount of the photosensitive media passing through the processing channel. The processing channel is preferably a narrow processing channel in a low volume processor.

The present invention further relates to a method of processing photosensitive media. The method comprises passing a photosensitive media to be processed through a processing channel which contains processing solution for application to the photosensitive media; and replenishing the processing solution in the processing channel by dispensing processing solution into the processing channel in direct relationship with an amount of the photosensitive media passing through the processing channel.

The present invention further relates to a replenishment system for a photographic processor. The replenishment system comprises a chamber for holding a processing solution therein and a dispensing mechanism which dispenses the processing solution from the chamber in direct relationship with an amount of photosensitive media being processed in a photographic processor.

The present invention further relates to a replenishment system for a photographic processor which comprises a chamber which holds a processing solution therein; and a dispensing mechanism which dispenses the processing solution from the chamber. The dispensing mechanism comprises a valve which has a surface that engages a cam roller. The cam roller is operationally connected to a conveying roller of a photographic processor so as to rotate together with the conveying roller, such that a rotation of the cam roller by way of a rotation of the conveying roller causes a movement of the valve between a closed position and an open position. In the open position of the valve, processing solution is dispensed from the chamber to the photographic processor.

DETAILED DESCRIPTION OF THE INVENTION

Figure 1:
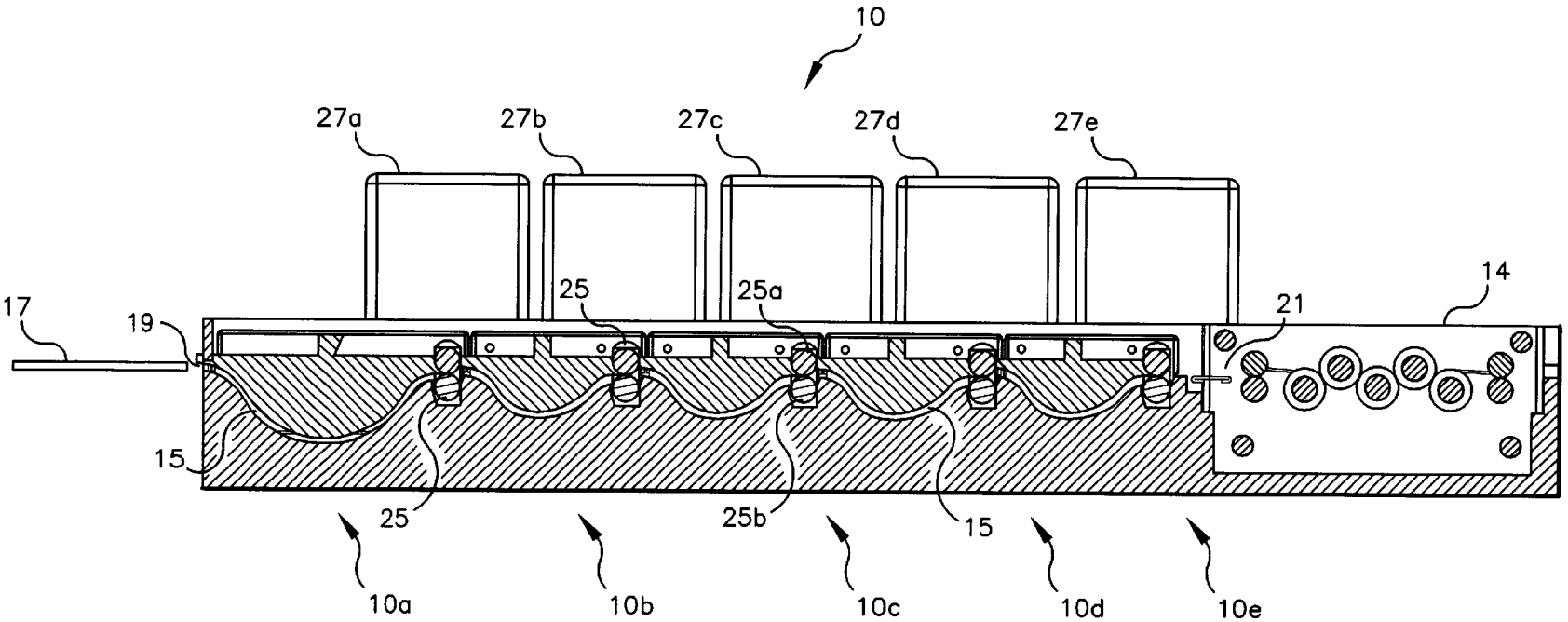
FIG. 1 is a side view of a processing arrangement in accordance with the present invention.
Figure 2:
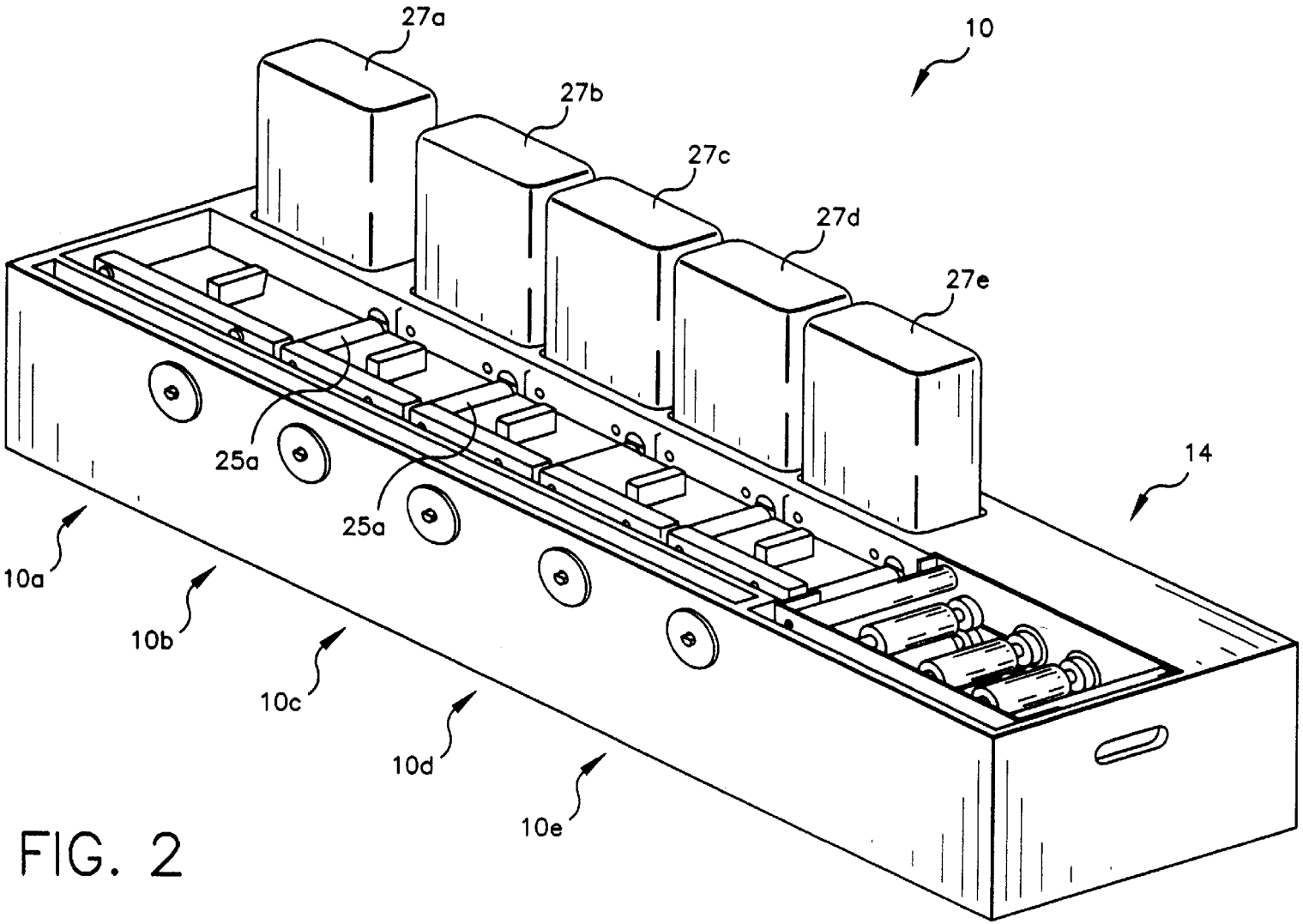
FIG. 2 is a perspective view of the processing arrangement of FIG. 1.

Referring now to the drawings, wherein like reference numerals represent identical or corresponding parts throughout the several views, FIGS. 1 and 2 illustrates a processing arrangement 10 having a plurality of processing sections or processors 10*a*–10*e*. Each processing section or processor 10*a*–10*e* may be designed to hold a processing solution for processing a photosensitive material passing therethrough.

In the embodiment illustrated in FIGS. 1 and 2, each individual processing section 10*a*–10*e* can be dedicated to, for example, a developing solution; a bleaching solution; a fixing solution; a stabilizer solution or a washing solution. FIGS. 1 and 2 also illustrate a dryer 14 positioned at an exit 21 of processing arrangement 10. Each of processing sections or processors 10*a*, 10*b*, 10*c*, 10*d* and 10*e* form a relatively thin or narrow processing channel 15 which extends through the entire processing arrangement 10. Reference can be made to, for example, U.S. Pat. Nos. 5,353,087 and 5,903,795 for examples of representative low volume processing arrangements having a narrow processing channel. During processing, and with reference to FIGS. 1 and 2, a photosensitive material 17 can be introduced into processing channel 15 at entrance 19. Photosensitive material 17 passes through each of processing sections or processors 10*a*–10*e* and is treated with an appropriate processing solution specific to that processing section or processor as it passes along processing channel 15. After processing, photosensitive material 17 is introduced to dryer 14 for drying. Each of processing sections 10*a*–10*e* includes a conveying roller arrangement 25. Each of conveying roller arrangements 25 can include a driven roller and a drive roller which is driven by way, for example, a motor and chain and belt drive assembly. Conveying roller arrangement 25 is effective to convey photosensitive material along processing channel 15 and through processing arrangement 10. Processing arrangement 10 can be designed in a manner such that a lower conveying roller of conveying roller arrangement 25 is at least partially immersed in the processing solution held in processing channel 15, (see for example, U.S. Pat. Nos. 5,903,795 and 5,353,087). However, the present invention is not limited to using a partially immersed lower roller as shown. For example, solution can be fed to the tank without contacting the rollers.

A feature of the present invention relates to the replenishment system for the processing solution. More specifically, as illustrated in FIGS. 1 and 2, the present invention includes a replenishment system which comprises a replenishment or dispensing chamber (27*a*, 27*b*, 27*c*, 27*d* and 27*e*) which holds replenishment processing solution particular to the processing section or processor 10*a*–10*e*. For example, replenishment chamber 27*a* will hold developing solution for processing of photosensitive material in processing section 10*a*. As photosensitive material 17 is processed and passes through processing channel 15, the processing solution is used up and needs to be replenished. The present invention provides for a unique replenishment system, the particulars of which are shown in FIG. 3, which replenishes processing solution based on what the photosensitive media or material extracts.

Figure 3:
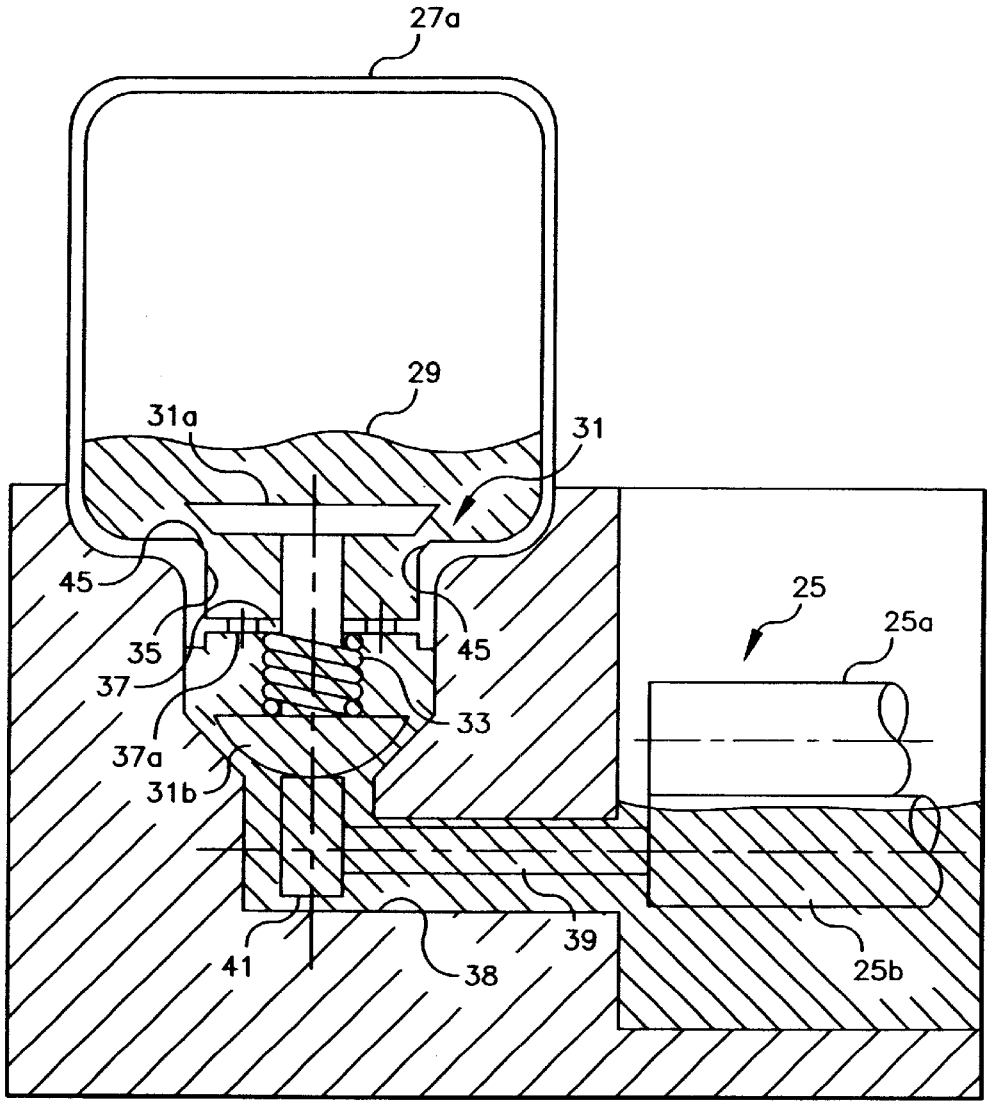
FIG. 3 is an isolated view illustrating a replenishment processing solution dispensing chamber and a dispensing mechanism for dispensing processing solution into the processing arrangement.
Figure 4A:
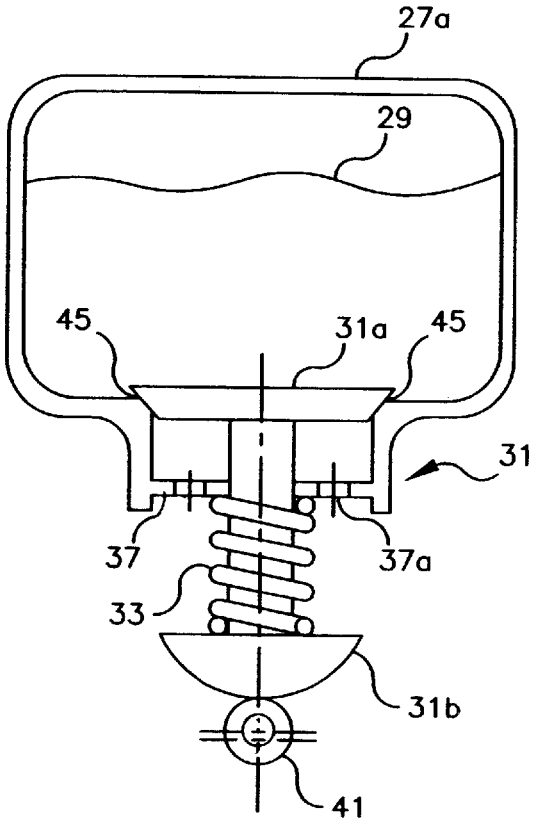
FIG. 4A is a view of a replenishment processing solution chamber with a valve of the dispensing mechanism being in a closed position.

More specifically, and referring to FIG. 3, this figure illustrates one replenishing or dispensing chambers 27*a*. It is recognized that replenishment chambers 27*b*–27*e* would be similar in structure to replenishment chamber 27*a* and thus, the present description will focus on replenishment chamber 27*a* as an example. As illustrated in FIG. 3, the replenishment system comprises a replenishment or dispensing chamber 27*a* which holds a replenishment processing solution 29 therein and a dispensing mechanism. The dispensing mechanism includes a valve 31 positioned at an opening or aperture 35 of chamber 27*a*. Valve 31 includes a first member 31 a which is effective to seal or close off opening 35 in a closed position of valve 31. Valve 31 further includes a second member 31*b* which is designed to abut against a cam in a manner which will be described later. Valve 31 also includes a spring member 33 which abuts against a frame 37 of chamber 27*a* and provides a biasing force to urge valve 31 to the closed position as illustrated in FIG. 4*a*. Frame 37 includes openings 37*a* to permit the passage of fluid therethrough.

Referring back to FIG. 3, conveying roller arrangement 25 is also shown. Conveying roller arrangement 25 includes a first or upper conveying roller 25*a* and a second or lower conveying roller 25*b*. One of the first and second rollers 25*a*, 25*b* is a drive roller and the other is a driven roller. For descriptive purposes, it will be assumed that roller 25*b* is a drive roller that is driven by a known motor and chain or belt drive arrangement. Roller 25*b* is also immersed in processing solution, while processing channel 15 extends between rollers 25*a*, 25*b*.

Figure 4B:
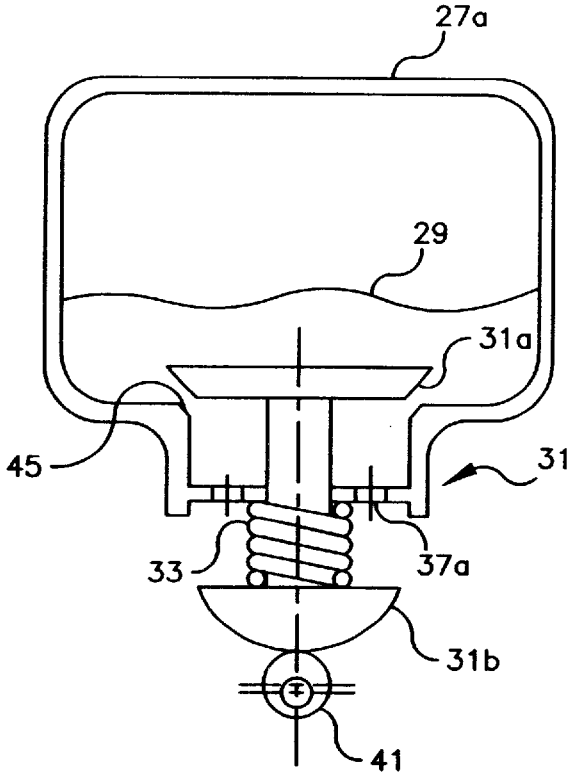
FIG. 4B is a view of the replenishment processing solution chamber of FIG. 4A showing the valve in an open position.

As illustrated in FIG. 3, roller 25*b* includes a shaft 39 that is connected to roller 25*b* and extends from roller 25*b* to an eccentric cam member or roller 41. Thus, eccentric cam roller 41 rotates in coordination with a rotation of roller 25*b*. As illustrated in FIGS. 3, 4A and 4B, eccentric cam roller 41 has an outer surface which abuts against an outer surface of second member 31*b* of valve 31. Therefore, based on the rotation of roller 25*b*, eccentric cam roller 41 will rotate accordingly. Of course, it is recognized that the present invention is not limited to an eccentrically mounted cam roller 41 as illustrated. As an alternative, cam roller 41 could be mounted at its rotational center and have an outer surface which varies by an amount necessary to move valve 31 the appropriate amount.

Operation of the replenishment system as illustrated in the FIGS. 3, 4A and 4B will now be described using processing section 10*a* and chamber 27*a* as examples. As photosensitive material 17 is introduced into narrow processing channel 15, it will be conveyed along processing channel 15. As the photosensitive material passes between rollers 25*a*, 25*b*, roller 25*b* will be rotated to convey the photosensitive material therethrough. The rotation of roller 25*b* in accordance with the passage of photosensitive material therethrough causes a corresponding rotation of eccentric cam roller 41. Based on this, cam roller 41 moves from the position shown in FIG. 4A in which valve 31 is in a closed position. More specifically, in the position shown in FIG. 4A, eccentric cam roller 41 and valve 31 are in a closed position in which second member 31*a* abuts against sealing surface 45 to seal aperture or opening 35 of processing chamber 27*a*. In the closed position of FIG. 4A, spring member 33 which extends between frame 37 and second member 31*b*, provides for a biasing force for maintaining valve 31 in the closed position and more particularly, second member 31*a* abutted against sealing surfaces 45 of chamber 27*a*. As cam roller 41 is rotated in accordance with the corresponding rotation of roller 25*b*, i.e. when photosensitive material is passing between rollers 25*a*, 25*b*, cam roller 41 will be rotated from the closed position illustrated in FIG. 4A to the open position illustrated in FIG. 4B.

More specifically, as cam roller 41 rotates, an outer surface of cam roller 41 abuts against an outer surface of second member 31*b* of valve 31 to urge valve member 31 against the biasing force of spring member 33. This causes the movement of valve 31 to the open position so as to separate first member 31*a* from sealing surfaces 45 and thus, open aperture or opening 35 of chamber 27*a*. In the open position shown in FIG. 4B, the replenishment solution in chamber 27*a* is dispensed via a solution path 38 to the processor or processing channel 15 in direct relationship with the amount of photosensitive media that passes through processing channel 15. Thus, if the photosensitive media is a longer piece of media, more replenishment solution will be dispensed to the processor or processing channel 15, and if a shorter piece of media passes between rollers 25*a*, 25*b*, a smaller amount of replenishment solution will be dispensed to the processor or processing channel 15. Therefore, the replenishment processing solution is metered or dispensed in correlation with the amount of processing solution extracted by the media. Further, the amount of replenishment solution dispensed is related or tied to the driving of the media through processing channel 15. More specifically, the rotation of cam roller 41 is tied to the rotation of roller 25*b* which is related to the passage of photosensitive media between rollers 25*a*, 25*b*.

Accordingly, when valve 31 is in a closed position as illustrated in FIG. 4A, photosensitive media is not in the vicinity of rollers 25*a*, 25*b* and rollers 25*a* and 25*b* are not being rotated, i.e., photosensitive media is not yet at conveying roller arrangement 25 or has already passed conveying roller arrangement 25. When valve 31 is in the opened position as illustrated in FIG. 4B for dispensing processing solution, the photosensitive media is in the vicinity of conveying roller arrangement 25. More specifically, the photosensitive media is passing between the rollers 25*a*, 25*b* with roller 25*b* being rotated and causing a corresponding rotation of eccentric cam roller 41.

In a preferred method of operation the rotation of roller 25*b* which causes a rotation of cam roller 41 is controlled such that valve 31 is in the opened position only when media is being transported and in the closed position when media exits the processor.

Thus, the present invention provides for a processor or processing arrangement in which a dispensing mechanism is provided that meters an amount of replenishment solution in direct relationship to the amount of media that passes through the processor. The system of the present invention is also effective to meter an amount of replenishment processing solution at a sufficient strength to provide an appropriate amount of active chemistry for processing of the photosensitive media in the processing channel. The dispensing mechanism includes a cam roller that is operationally associated with a conveying or drive roller. The cam roller is rotated in association with the conveying or drive roller and engages a valve on a dispensing or replenishment chamber. When the valve is pushed up or moved to an opened position, an amount of processing solution is metered out or dispensed in response to the amount that the drive or conveying roller is rotated. With this arrangement, a longer piece of media will get more replenishment. The photosensitive media used in the present invention is preferably in the form of discrete pieces of media.

As indicated above, it is recognized that replenishment chambers 27*b*–27*e*, as well as the valve, cam rollers and conveying or drive rollers associated with replenishment chambers 27*b*–27*e* are similar in structure to the described replenishment chamber 27*a* and operate in the same manner. Therefore, as photosensitive material conveyed through processing channel 15 passes through processing sections 10*b*–10*e*, replenishment solution is dispensed from each of replenishment chambers 27*b*–27*e* in the same manner as described with reference to replenishment chamber 27*a*.

The invention has been described in detail with particular reference to certain preferred embodiments thereof, but it will be understood that variations and modifications can be effected within the spirit and scope of the invention.

What is claimed is:

1. A processor for processing photosensitive media, the processor comprising:

a processing channel through which a photosensitive media is passed, said processing channel containing processing solution for application to the photosensitive media passing therethrough;

a replenishment system adapted to replenish the processing solution in said processing channel, said replenishment system comprising a chamber for holding a processing solution therein and a dispensing mechanism which dispenses the processing solution from said chamber in direct relationship with an amount of the photosensitive media passing through said processing channel;

a valve having an open position and a closed position for opening and closing an aperture of said chamber, such that in said open position of said valve, processing solution in said chamber is dispensed from said chamber to said processing channel by way of a solution path which extends from said chamber to said processing channel, the opening and closing of said valve being in direct relation to the amount of said photosensitive media passing through said channel, and a cam roller positioned in said solution path, said cam roller being adapted to maintain said valve in either the open position or the closed position based on the passage of the photosensitive media through the processing channel.

2. A processor according to claim 1, wherein said photosensitive media comprises a plurality of discreet pieces of media.

3. A processor according to claim 1, wherein an amount of dispensed processing solution is of sufficient strength to provide an appropriate amount of active chemistry for processing of said photosensitive media in said processing channel.

4. A processor according to claim 1, wherein the processing solution is a developer solution.

5. A processor according to claim 1, wherein said processing solution is a wash solution.

6. A processor for processing photosensitive media, the processor comprising:

a processing channel through which a photosensitive media is passed, said processing channel containing processing solution for application to the photosensitive media passing therethrough;

a replenishment system adapted to replenish the processing solution in said processing channel, said replenishment system comprising a chamber for holding a processing solution therein and a dispensing mechanism which dispenses the processing solution from said chamber in direct relationship with an amount of the photosensitive media passing through said processing channel;

a valve having an open position and a closed position for opening and closing an aperture of said chamber, such that in said open position of said valve, processing solution in said chamber is dispensed from said chamber to said processing channel the opening and closing of said valve being in direct relation to the amount of said photosensitive media passing through said channel;

a conveying roller positioned at the processing channel and adapted to convey photosensitive media along the processing channel; and a cam roller operationally associated with said conveying roller so as to rotate with said conveying roller;

wherein:

in response to a rotation of said conveying roller said cam roller is rotated to move said valve to said open position and maintain said valve in said open position while said photosensitive media is in a vicinity of said conveying roller; and in response to a further rotation of said conveying roller said cam roller is further rotated to permit a movement of said valve to said closed position when said photosensitive media is not in a vicinity of said conveying roller.

7. A processor according to claim 6, further comprising a spring member having a biasing force which urges said valve in a direction toward said closed position and maintains said valve in said closed position, such that said cam roller moves the valve toward said open position against the biasing force of said spring member.

8. A processor for processing photosensitive media, the processor comprising:

a processing channel through which a photosensitive media is passed, said processing channel containing processing solution for application to the photosensitive media passing therethrough; and a replenishment system adapted to replenish the processing solution in said processing channel, said replenishment system comprising a chamber for holding a processing solution therein and a dispensing mechanism which dispenses the processing solution from said chamber in direct relationship with an amount of the photosensitive media passing through said processing channel;

wherein said dispensing mechanism comprises a first member movable between open and closed positions to respectively open and close an opening in said chamber, and a second member operatively connected to said first member and having a surface which contacts a cam member;

wherein:

a rotation of said cam member is based on a passage of photosensitive media in said processing channel; and said cam member is adapted to abut against said second member to cause a corresponding movement of said first member between said open and closed positions.

9. A method of processing photosensitive media, the method comprising:

passing a photosensitive media to be processed through a processing channel which contains photosensitive solution for application to the photosensitive media; and replenishing the processing solution in the processing channel by dispensing processing solution into the processing channel in direct relationship with an amount of the photosensitive media passing through the processing channel;

wherein said processing solution to be dispensed is held in a chamber comprising a valve having a surface which engages a cam roller, said valve being movable between open and closed positions for respectively opening and closing an opening in said chamber, such that said replenishing step comprises moving said valve from the closed position to the open position to dispense processing solution from said chamber to said processing channel via said opening in relation to a passage of photosensitive material through said processing channel, said cam roller being adapted to maintain said valve in either the open position or the closed position based on the passage of the photosensitive material through said processing channel.

10. A method according to claim 9, wherein said replenishing step comprises dispensing processing solution of a sufficient strength to provide an appropriate amount of active chemistry for processing to said photosensitive media in said processing channel.

11. A method according to claim 9, wherein said processing solution is a developer solution.

12. A method according to claim 9, wherein said processing solution is a washing solution.

13. A replenishment system for a photographic processor, the replenishment system comprising:

a chamber for holding a processing solution therein and a dispensing mechanism which dispenses the processing solution from said chamber in direct relationship with an amount of photosensitive media being processed in a photographic processor, said dispensing mechanism comprising a member which is adapted to open and close an opening in said chamber, said member being adapted to contact a cam roller whose rotation is based on a passage of photosensitive media in the processor, wherein the rotation of said cam roller moves said member to open and close the opening.

14. A replenishment system for a photographic processor, the replenishment system comprising:

a chamber which holds a processing solution therein; and a dispensing mechanism which dispenses the processing solution from the chamber, said dispensing mechanism comprising a valve having a surface which engages a cam roller, said cam roller being operationally connected to a conveying roller of a photographic processor so as to rotate together with the conveying roller, such that a rotation of said cam roller by way of a rotation of said conveying roller causes a movement of the valve between a closed position and an open position, wherein in said open position of said valve, processing solution is dispensed from said chamber to the photographic processor.

* * * * *